US009151012B2

(12) United States Patent
Seda et al.

(10) Patent No.: US 9,151,012 B2
(45) Date of Patent: Oct. 6, 2015

(54) DUAL-MODE THUMB FOR EXCAVATOR

(75) Inventors: Anthony G. Seda, Revenna, OH (US); James J. Crook, Bedford, TX (US)

(73) Assignee: Paladin Brands Group, Inc., Oak Brook, IL (US)

( * ) Notice: Subject to any disclaimer, the term of this patent is extended or adjusted under 35 U.S.C. 154(b) by 256 days.

(21) Appl. No.: 13/585,662

(22) Filed: Aug. 14, 2012

(65) Prior Publication Data

US 2013/0042507 A1 Feb. 21, 2013

Related U.S. Application Data

(60) Provisional application No. 61/523,796, filed on Aug. 15, 2011.

(51) Int. Cl.
*E02F 3/40* (2006.01)

(52) U.S. Cl.
CPC ..... *E02F 3/404* (2013.01); *Y10T 29/49716* (2015.01)

(58) Field of Classification Search
CPC ..... E02F 3/404; E02F 3/96
USPC ..... 37/403, 404, 405, 406, 407, 408, 409, 37/410, 468, 903
See application file for complete search history.

(56) References Cited

U.S. PATENT DOCUMENTS

| | | | | | |
|---|---|---|---|---|---|
| 3,214,138 | A * | 10/1965 | Jocher et al. | 254/124 |
| 4,285,628 | A * | 8/1981 | Jankowski | 414/739 |
| 4,519,739 | A * | 5/1985 | Risch | 414/724 |
| 4,804,309 | A * | 2/1989 | Risch | 414/704 |
| 4,907,356 | A * | 3/1990 | Labounty | 37/406 |
| 5,094,581 | A * | 3/1992 | Lamb | 414/24.5 |
| 5,111,602 | A * | 5/1992 | Risch | 37/406 |
| 5,472,308 | A * | 12/1995 | Somero | 414/724 |
| 5,553,408 | A | 9/1996 | Townsend | |
| 5,678,332 | A | 10/1997 | Hawkins | |
| 5,813,822 | A * | 9/1998 | Pisco | 414/723 |
| 5,921,302 | A * | 7/1999 | Petersen | 144/334 |
| 5,957,650 | A * | 9/1999 | Rollo | 414/724 |
| 6,450,081 | B1 | 9/2002 | Sorbel | |
| 6,655,054 | B1 * | 12/2003 | Ward | 37/406 |
| 6,742,291 | B2 * | 6/2004 | Frigon et al. | 37/406 |
| 7,165,930 | B2 | 1/2007 | Pisco | |
| 7,240,441 | B2 * | 7/2007 | McCoy | 37/406 |
| 7,617,619 | B2 * | 11/2009 | Cox | 37/406 |
| 7,673,403 | B2 * | 3/2010 | Bridges | 37/403 |
| 7,753,641 | B2 | 7/2010 | Seljestad | |
| 7,818,901 | B2 * | 10/2010 | Zeno et al. | 37/406 |
| 7,934,758 | B2 | 5/2011 | Stamey et al. | |
| 8,695,239 | B2 * | 4/2014 | Seda et al. | 37/406 |
| 2002/0101107 | A1 | 8/2002 | Cunningham et al. | |
| 2003/0024138 | A1 * | 2/2003 | Frigon et al. | 37/406 |
| 2003/0167662 | A1 | 9/2003 | Desrochers | |
| 2006/0283052 | A1 * | 12/2006 | Kremer | 37/219 |
| 2010/0058622 | A1 * | 3/2010 | Calvert et al. | 37/405 |

* cited by examiner

*Primary Examiner* — Jamie L McGowan
(74) *Attorney, Agent, or Firm* — Fay Sharpe LLP

(57) ABSTRACT

A thumb body is pivotally connected to a first mount, and a stiff-arm anchor is connected to and extends between the first mount and a second mount. The stiff-arm anchor is selectively removable from the first and second mounts. A stiff-arm support link includes a first end connected to the thumb body and a second end connected to the stiff-arm anchor. The thumb can be converted from a hydraulic mode to a stiff-arm or fixed mode by disconnecting the first end of a hydraulic cylinder actuator from the thumb body and disconnecting the second end of the hydraulic cylinder actuator from the second mount, and by installing the stiff-arm anchor and stiff-arm support link.

10 Claims, 5 Drawing Sheets

DUAL-MODE THUMB FOR EXCAVATOR

CROSS-REFERENCE TO RELATED APPLICATION

This application claims priority from and benefit of the filing date of U.S. Provisional Patent Application Ser. No. 61/523,796 filed Aug. 15, 2011, and the entire disclosure of said provisional patent application is hereby expressly incorporated by reference.

BACKGROUND

Thumbs for excavators are well known (the term "excavator" as used herein is intended to encompass excavators, backhoes, and other machines having an arm or "dipper stick" that carries a bucket or other work implement). These thumbs are secured to the arm of the excavator and are arranged relative to the bucket or other work implement so as to provide an opposable member to aid in grasping large or odd-shaped objects and/or for other purposes. The thumb includes a body having an inner end secured to the excavator arm and an outer end that is spaced outwardly from the arm. The outer end can have any of a wide variety of shapes and sizes, depending upon the work being performed, e.g., carrying logs, carrying demolition debris, lifting large rocks or metal plates, and similar activities.

Known thumbs are either a fixed or "stiff-arm" type that is set to a desired operative position, or a continuously remotely adjustable "hydraulic" type in which the angular position of the thumb body relative to the excavator arm is selectively continuously adjustable using a remotely controlled hydraulic cylinder or other actuator controlled by the machine operator from the operator's cab. These known thumbs cannot be quickly and conveniently changed from one type to the other once installed on an excavator, because the stiff-arm thumb requires a different base mounting structure to be installed on the excavator arm as compared to a hydraulic thumb.

SUMMARY

In accordance with one aspect of the present development, a thumb for an excavator includes first and second spaced apart mounts. A thumb body is pivotally connected to the first mount. A stiff-arm anchor is connected to and extends between the first and second mounts. The stiff-arm anchor is releasably connected to the first and second mounts so as to be selectively removable from the first and second mounts. A stiff-arm support link includes a first end connected to the thumb body and a second end connected to the stiff-arm anchor.

In accordance with another aspect of the present development, a method for converting an excavator thumb from a first mode to a second mode includes disconnecting a first end of a hydraulic cylinder actuator from a thumb body. The thumb body is pivotally connected to a first mount. The method also includes disconnecting a second end of the hydraulic cylinder actuator from a second mount that is spaced from the first mount. The hydraulic cylinder actuator is removed from the thumb body and the second mount. A stiff-arm anchor is connected to the first and second mounts. A first end of a stiff-arm support link is connected to the thumb body and a second end of the stiff arm support link is connected to the stiff arm anchor.

DETAILED DESCRIPTION

Figure 1:
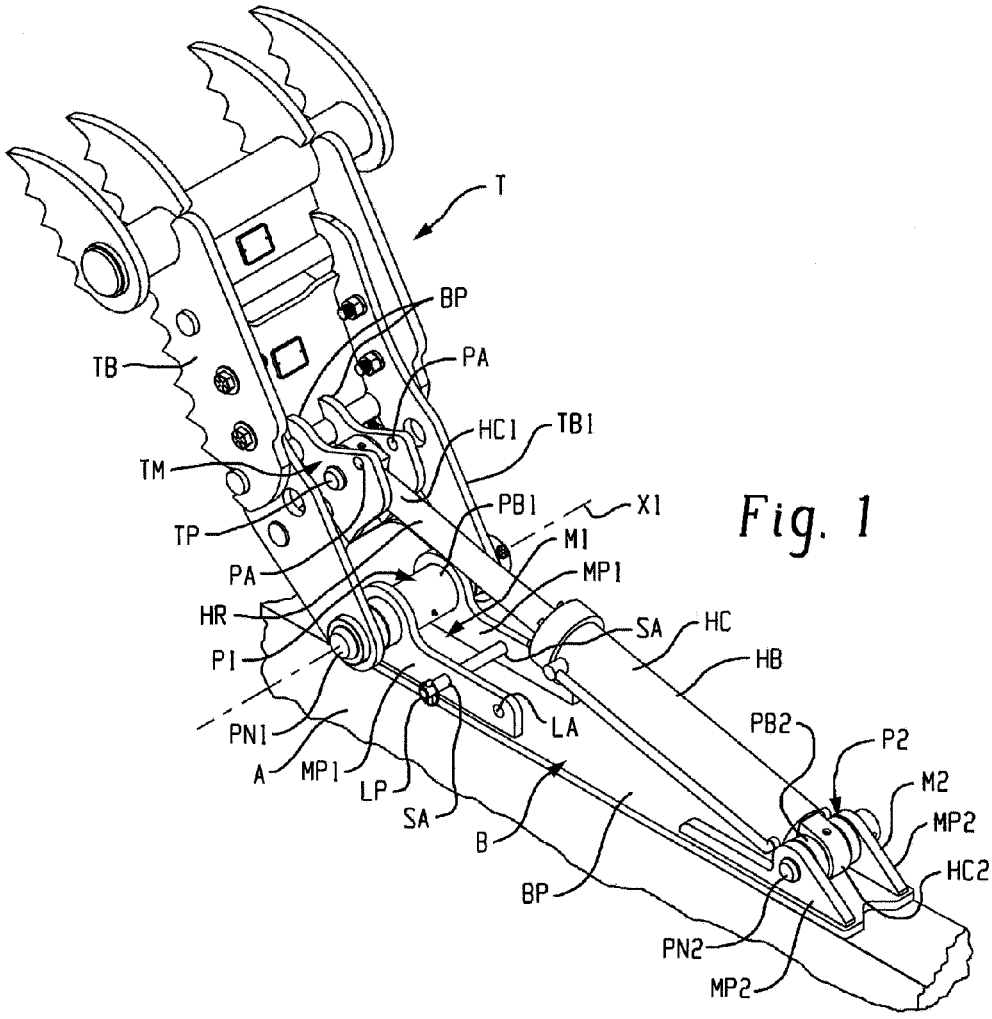
FIG. 1 is an isometric view of a dual-mode thumb for an excavator according to the present development shown in its continuously adjustable (hydraulic) mode, with the associated excavator arm partially shown.
Figure 2:
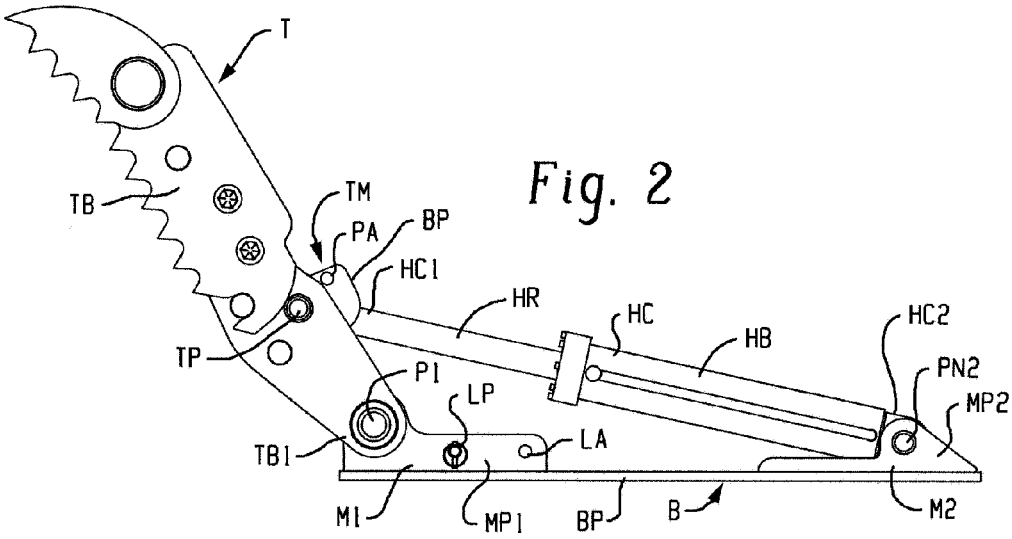
FIG. 2 is a side view of the thumb shown in FIG. 1.

FIG. 1 is an isometric view of a convertible or dual-mode thumb T for an excavator according to the present development shown in its continuously adjustable (hydraulic) mode. The thumb T is mounted to an associated excavator arm A which is only partially shown. More particularly, the thumb T comprises a base B that is welded or otherwise fixedly secured to the arm A and a thumb body TB comprising an inner end TB1 that is pivotally connected to the base B such that the thumb body TB pivots relative to the arm A about a pivot axis X1. FIG. 2 provides a side view of the thumb T (the associated excavator arm A is not shown in FIG. 2). The thumb body TB includes ribs, tines and/or other structures that are adapted for grasping materials or otherwise performing work.

The base B of the thumb T comprises one-piece or multiple, separate pieces that are welded or otherwise fixedly secured to the excavator arm A. The base B comprises a first mount or mount portion M1 to which the thumb body inner end TB1 is pivotally mounted and comprises a second mount or mount portion M2 spaced from the first mount M1. As shown, the first and second mounts M1,M2 are connected to a common base plate BP portion of the base B, but need not be. The first and or second mounts M1,M2 can also be defined as part of the arm A.

The thumb T further comprises a selectively extensible and retractable actuator such as a hydraulic cylinder HC as shown. The actuator HC is remotely controlled from an operator's cab in order to adjust and maintain an angular position of the thumb body TB relative to the associated arm A about the pivot axis X1 by lengthening and shortening the overall length of the hydraulic cylinder HC. In the illustrated embodiment, the first and second mounts M1,M2 of the base comprise respective clevis portions defined by parallel spaced-apart first mounting plates MP1 (for the first mount M1) and spaced-apart second mounting plates MP2 (for the second mount M2). The first mounting plates MP1 include respective aligned apertures or are otherwise configured for a pin-on connection of the thumb body inner end TB1 to the first mount using a first pin assembly P1. The second mounting plates MP2 include respective aligned apertures or are otherwise configured for a pin-on connection of an inner or second end HC2 of the hydraulic cylinder HC thereto using a second pin assembly P2. As shown herein, the first pin assembly P1 comprises a first removable pin PN1 and one or more optional first pin bushings PB1 that extend between the first mounting plates MP1 and through which the first removable pin PN1 extends. Likewise, the second pin assembly P2 comprises a second removable pin PN2 and one or more optional second spacers PB2 connected to the second mounting plates MP2 and through which the second removable pin PN2 extends.

The thumb body TB includes a mount TM spaced from the first mount M1 and pivot axis X1 and comprising parallel spaced-apart, body mount plates BP. The hydraulic cylinder HC or other actuator includes an outer or first end HC1 that is pivotally connected to the thumb body mount TM by a pin TP such that the actuator HC is operably connected between the thumb body TB and the second mount M2 of the base B. As shown, the inner or second end HC2 of the actuator HC comprises a body HB and the outer or first end HC1 comprises a piston rod HR that is selectively extensible from and retractable into the body HB under force of hydraulic fluid as controlled remotely from the excavator cab. The orientation of the cylinder HC could be reversed if desired.

Figure 3:
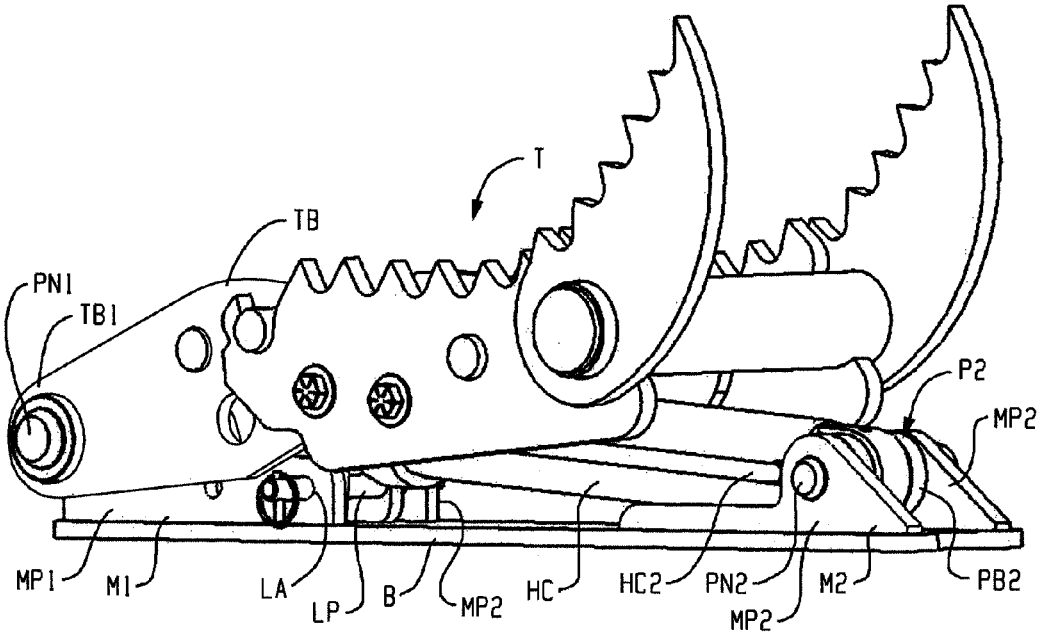
FIG. 3 shows the thumb of FIG. 1 in its stored, inoperative position.

FIG. 3 shows an inoperative or storage position of the thumb T, in which the hydraulic cylinder HC or other actuator is fully retracted such that the thumb body TB lies adjacent the base B and extends between the first and second mounts M1,M2. The thumb body mount TM or other location preferably comprises at least one or, as shown, an aligned pair of pin apertures PA (see FIGS. 1 & 2), and the first mount M1 of the base B comprises an aligned pair of lock apertures LA defined in the first mounting plates MP1. When the thumb body TB is positioned in its inoperative storage position as shown in FIG. 3, a lock pin LP is slidably engaged with both the lock apertures LA of the base B and the pin apertures PA of the thumb body mount TM such that the thumb body TB is captured to the first mount M1 of the base B to prevent sagging or other unintended movement of the thumb body TB relative to the base B. When it is not in use, the lock pin LP can be stored elsewhere or it can be stored in the lock apertures LA or in an aligned pair separate pin storage apertures SA that are defined in the mounting plates MP1 of the first mount M1, as shown in FIG. 1.

Figure 4:
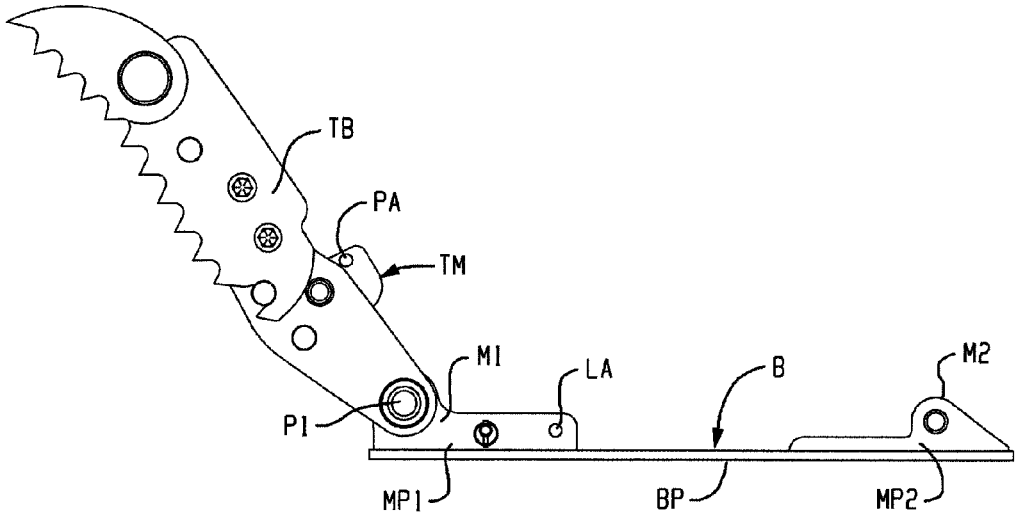
FIG. 4 is a side view similar to FIG. 2, but shows the hydraulic cylinder removed for the purpose of converting the thumb from its continuously adjustable (hydraulic) mode to its fixed (stiff-arm) mode.

FIG. 4 is a side view similar to FIG. 2, but shows the hydraulic cylinder HC removed for the purpose of converting the thumb T from its continuously adjustable (hydraulic) mode to its fixed (stiff-arm) mode.

Figure 5:
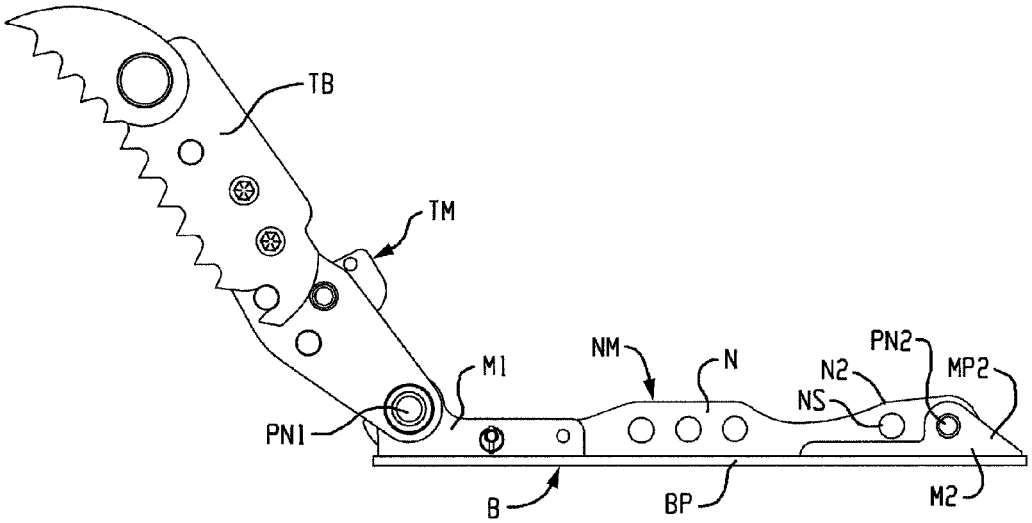
FIG. 5 is similar to FIG. 4 but shows a stiff-arm anchor installed on the base of the thumb.
Figure 6:
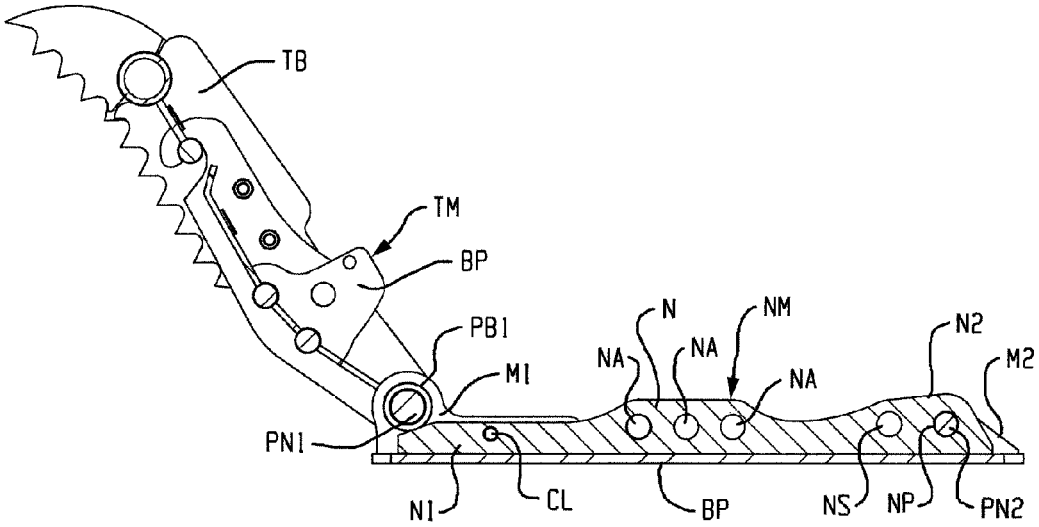
FIG. 6 is similar to FIG. 5 but provides a section view to reveal the connection of the stiff-arm anchor to the base of the thumb.

FIG. 5 is similar to FIG. 4 but shows a stiff-arm anchor N removably installed on and releasably connected to the base B and extending between the first and second mounts M1,M2. FIG. 6 provides a section view of FIG. 5. The anchor N comprises an elongated member comprising a first end N1 and an opposite second end N2. Preferably, the anchor N comprises a one-piece steel or other metallic member defined from a plate or other material. The first end N1 is conformed and dimensioned to be selectively engaged with the first pin assembly P1 or other part of the first mount M1, and the second end N2 is conformed and engaged to be selectively engaged with the second pin assembly P2 or other part of the second mount M2. In the illustrated embodiment, the first end N1 is wedge-shaped or otherwise dimensioned and shaped to fit tightly between the first pin assembly P1 and the base B (or excavator arm A) so as to be captured beneath the pin bushing PB1 or other part of the first pin assembly P1, between the pin assembly P1 and the base plate BP (if base plate BP is present) or the excavator arm A (if the base plate BP is not present) or other fixed structure adjacent the first pin assembly P1, so that the first end N1 is secured to the first mount M1. In the illustrated embodiment, the second end N2 comprises an aperture NP, and the second removable pin PN2 of the second pin assembly P2 extends through the aperture NP to fixedly secure the second end N2 of the anchor N to the second mount M2. To install the anchor N, its first end N1 is wedged beneath the first pin assembly P1 (between the first pin assembly P1 and the base plate BP or arm A) and its second end N2 is pinned to the second mount M2 between the second mounting plates MP2 using the second removable pin PN2. Alternatively, the second end N2 of the anchor N can be captured between the second pin assembly P2 and the base plate BP or arm A or other adjacent fixed structure, and the first end N1 can be pinned or otherwise releasably secured to the first mount M1, or the first and second ends N1,N2 of the anchor N can be pinned or otherwise releasably secured to the respective first and second mounts M1.M2.

Thus, as shown in FIGS. 5 and 6, the anchor N is selectively releasably and fixedly secured to the base B. Optionally, the anchor N includes a clearance hole CL that is registered with the pin storage apertures SA of the first mounting plates MP1 so as to be positioned to accommodate passage of the lock pin LP therethrough when the lock pin LP is located in the pin storage apertures SA (if present, the lock pin LP also retains the anchor N to the first mounting plates MP1, but this is not its primary function). If the clearance hole CL is not provided (and/or if the pin storage apertures SA are not provided), the lock pin LP must be stored elsewhere when the anchor N is operatively installed on the base B.

Figure 7:
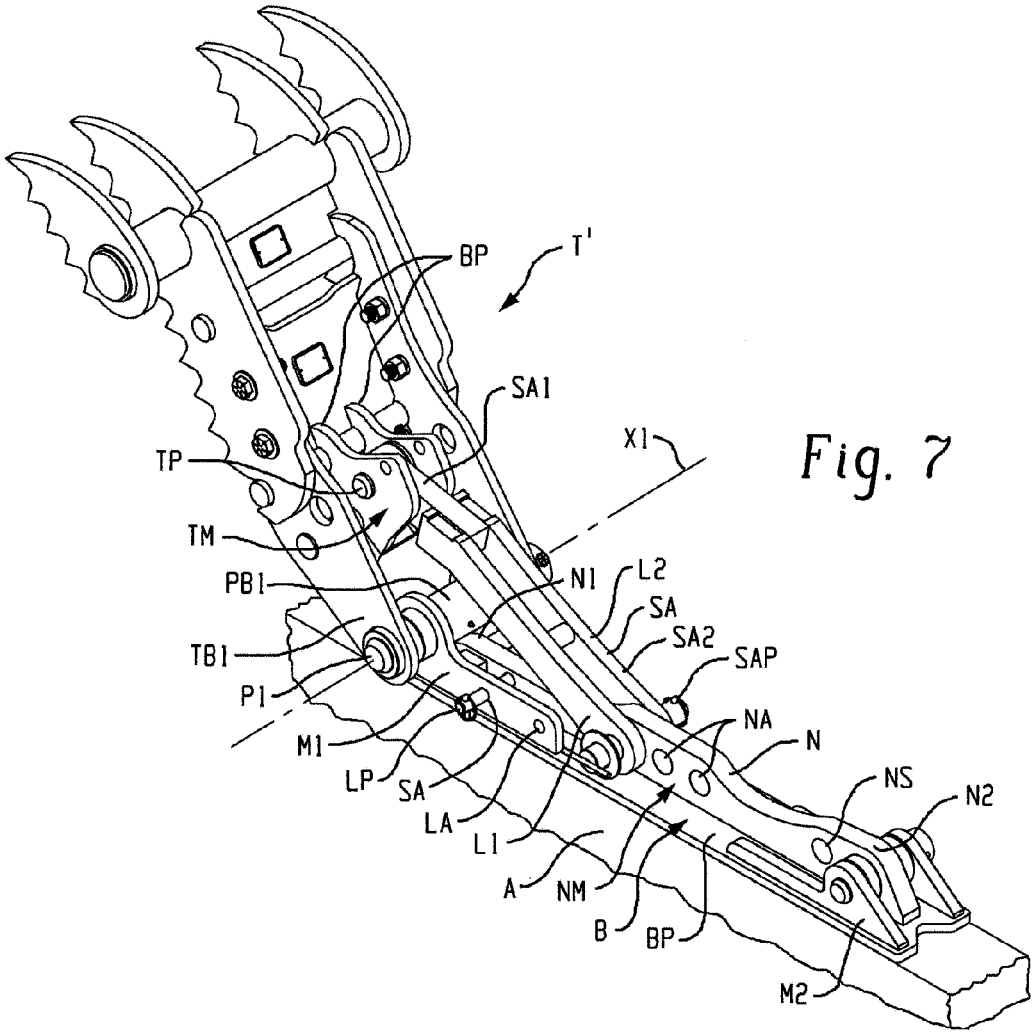
FIG. 7 is an isometric view of the dual-mode thumb for an excavator according to the present development shown in its fixed or stiff-arm mode, with the associated excavator arm partially shown.
Figure 8:
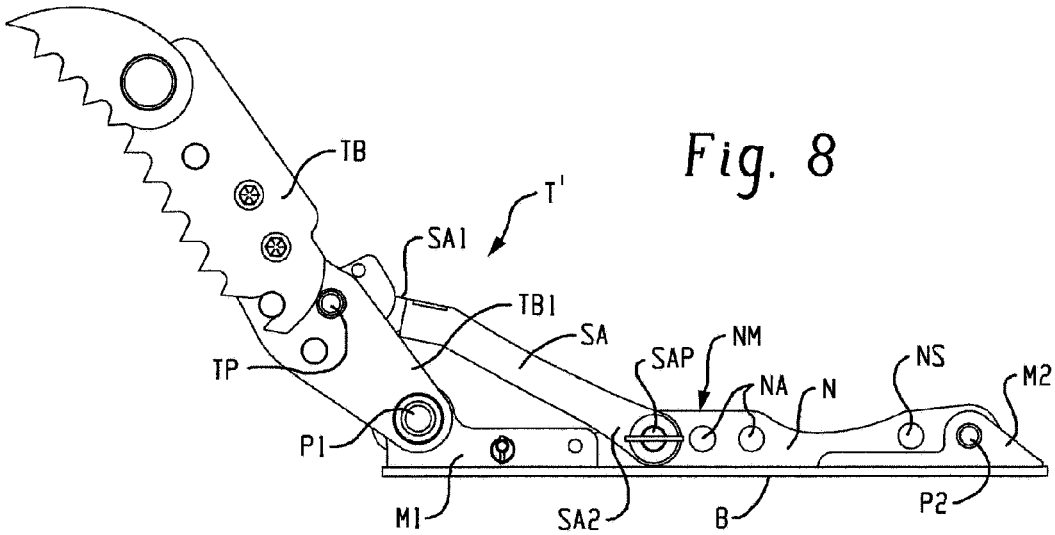
FIG. 8 is a side view of the thumb shown in FIG. 7.

With reference also to FIGS. 7 and 8, when the anchor N is connected to the base B, the thumb is alternatively configured as a fixed or stiff-arm thumb T' instead of the continuously adjustable or hydraulic thumb T described above. Like the hydraulic thumb T, the stiff-arm thumb T' comprises the base B, and the inner end TB1 of the thumb body TB is pivotally connected to the first mount M1 of the base B by the first pin assembly P1 so that the thumb body TB selectively pivots about the pivot axis X1 by manual force.

In place of the hydraulic cylinder or other actuator HC, a fixed-length or manually adjustable variable length stiff-arm support link or stiff-arm SA is operatively installed between the base B and the thumb body TB. The stiff-arm SA includes a first end SA1 that is pivotally connected to the thumb body mount TM using the pin TP. A second end SA2 of the stiff-arm SA is operatively releasably connected to a stiff-arm mounting location NM of the anchor N. In the illustrated embodiment, the stiff-arm mounting location NM of the anchor N comprises at least one and preferably multiple different mounting apertures NA spaced-apart along a longitudinal axis of the stiff-arm anchor N (i.e., spaced at varying distances between the first and second mounts M1,M2), and the second end SA2 of the stiff-arm SA is fixedly secured to the anchor mounting location NM by a stiff-arm pin SAP installed through aligned apertures formed in the second end SA2 of the stiff-arm and one of the mounting apertures NA. As shown, the second end SA2 of the stiff-arm is bifurcated such that the stiff-arm mounting location NM of the anchor N is received between first and second legs L1,L2 of the stiff-arm SA, and the stiff-arm pin SAP is installed in aligned apertures respectively defined in the legs L1,L2 and one of the mounting apertures NA of the anchor N. When the anchor N comprises multiple different mounting apertures NA, the mounting location of the second end SA2 of the stiff-arm is variable between the mounts M1,M2 as desired to adjust/set the angular position of the thumb body TB relative to the base B at a desired angle. Alternatively or additionally, the stiff-arm SA, itself, can be a telescoping member or be otherwise structured to allow its length to be manually adjusted in order to vary the angular position of the thumb body TB.

Figure 9:
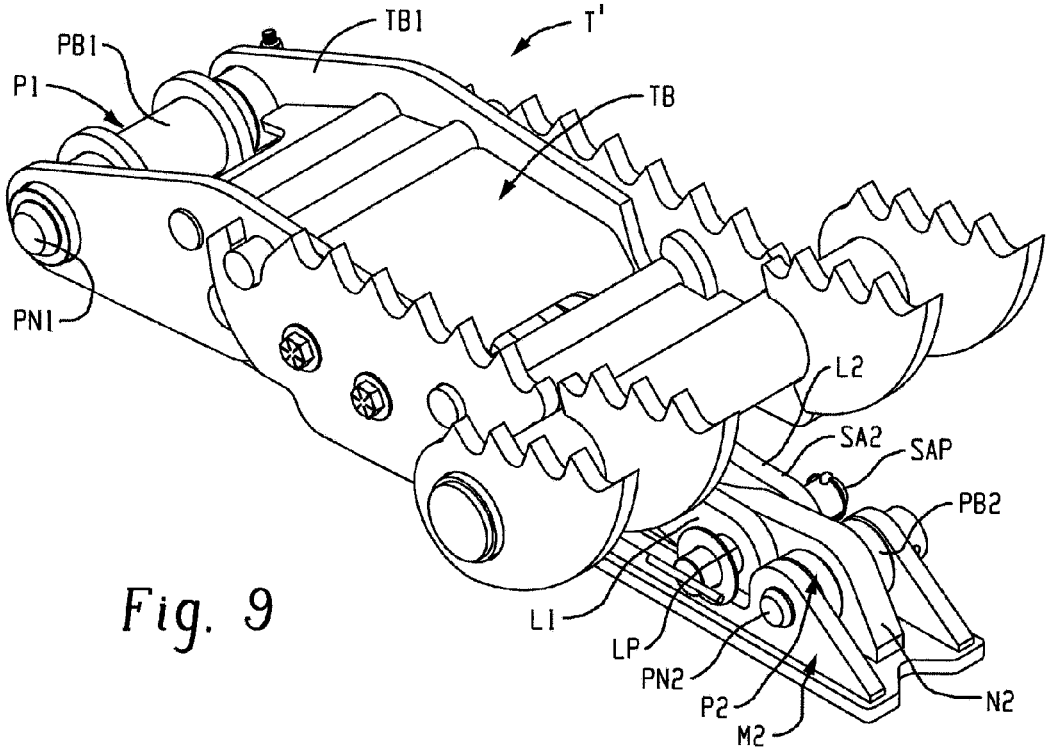
FIG. 9 shows the thumb of FIG. 7 in its stored, inoperative position.

FIG. 9 shows a storage position for the thumb T' in which the thumb body TB is pivoted to a position where it lies adjacent the base B and extends between the first and second mounts M1,M2. To secure the thumb T in this storage position, the second end N2 of the anchor N includes a storage aperture NS (see FIGS. 5-8). The second end SA2 of the stiff-arm is disengaged from one of the apertures NA of the stiff-arm mounting location NM on the anchor N, and the second end SA2 of the stiff-arm is then secured adjacent the anchor second end N2 by insertion of the stiff-arm pin SAP through the storage aperture NS of the anchor N and also through the registered apertures LP defined in the first and second legs L1,L2 located at the second end SA2 of the stiff-arm SA.

Figure 10:
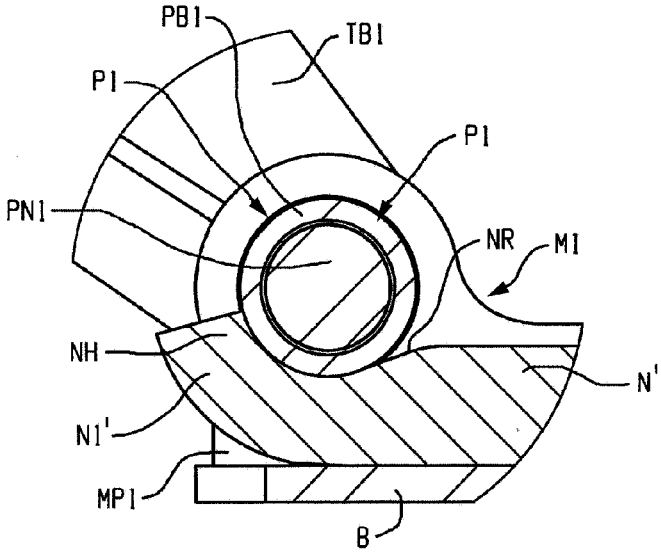
FIG. 10 illustrates a stiff-arm anchor according to an alternative embodiment installed on the thumb base.

FIG. 10 illustrates an alternative anchor N' comprising an alternatively structured first end N1'. The first end N1' is similar to the first end N1 of the anchor N, except that it further comprises a hook structure NH comprising a recess NR in which the first pin bushing PB1 or other part of the first pin assembly P1 is received when the anchor N' is connected to the base B by insertion of the first end N1' between the first pin assembly P1 and the base plate BP or arm A. This hook structure NH further captures the anchor N' to the first pin assembly P1. If the orientation of the stiff-arm anchor is reversed, the second end N2' can comprise the hook structure NH and recess NR in which the second pin bushing PB2 or other part of the second pin assembly P2 is received when the anchor N' is connected to the base B by insertion of the second end N2' between the second pin assembly P2 and the base plate BP or arm A.

The invention has been described with reference to preferred embodiments. Modifications and alterations will occur to those of ordinary skill in the art to which the invention pertains, and it is intended that the claims be construed as encompassing all such modifications and alterations.

The invention claimed is:

1. A thumb for an excavator, said thumb comprising:

first and second spaced apart mounts;

a thumb body pivotally connected to said first mount by a first removable pin assembly, said second mount comprising a second removable pin assembly adapted for selectively connecting an associated hydraulic cylinder actuator to said second mount;

a stiff-arm anchor connected to and extending between said first and second mounts, said stiff-arm anchor comprising first and second ends releasably connected to said first and second mounts, respectively, so as to be selectively removable from said first and second mounts; and, a stiff-arm support link comprising a first end connected to said thumb body and a second end connected to said stiff-arm anchor at a location on said stiff-arm anchor that is located between said first and second mounts, wherein one end of said stiff-arm anchor is pinned to a respective one of said first and second mounts, and the other end of said stiff-arm anchor is captured to the other respective one of said first and second mounts by insertion of said other end of said stiff-arm anchor between said respective pin assembly and an adjacent fixed structure.

2. The thumb for an excavator as set forth in claim 1, wherein said other end of said stiff-arm anchor comprises a hook structure including a recess in which said respective pin assembly is received.

3. The thumb for an excavator as set forth in claim 1, further comprising a base including a base plate to which both said first and second mounts are connected.

4. The thumb for an excavator as set forth in claim 1, further comprising a lock pin that is selectively engaged with both said first mount and said thumb body to capture said thumb body to said first mount when said thumb body is pivoted to a storage position in which it extends between said first and second mounts.

5. The thumb for an excavator as set forth in claim 4, wherein said first mount comprises parallel spaced-apart first mounting plates comprising respective lock apertures through which said lock pin extends, and wherein said stiff-arm anchor is located between said first mounting plates and comprises a clearance hole through which said lock pin extends.

6. The thumb for an excavator as set forth in claim 1, wherein said stiff-arm anchor comprises a stiff-arm mounting location to which said second end of said stiff-arm support link is connected, said stiff-arm mounting location comprising at least one mounting aperture defined in said stiff-arm anchor.

7. The thumb for an excavator as set forth in claim 6, wherein said stiff-arm mounting location comprises multiple spaced-apart mounting apertures and wherein said second end of said stiff-arm support link is selectively connected to said stiff-arm anchor by insertion of a stiff-arm pin through said second end of said stiff-arm support link and one of said mounting apertures.

8. The thumb for an excavator as set forth in claim 6, wherein said stiff-arm anchor further comprises a storage aperture defined therein, and said second end of said stiff-arm support link is selectively secured to said anchor by insertion of a stiff-arm pin through said second end of said stiff-arm support link and said storage aperture when said thumb body is pivoted to a storage position.

9. A thumb for an excavator, said thumb comprising:

first and second spaced apart mounts;

a thumb body pivotally connected to said first mount by a first removable pin assembly, said second mount comprising a second removable pin assembly adapted for selectively connecting an associated hydraulic cylinder actuator to said second mount;

a stiff-arm anchor connected to and extending between said first and second mounts, said stiff-arm anchor comprising first and second ends releasably connected to said first and second mounts, respectively, so as to be selectively removable from said first and second mounts; and, a stiff-arm support link comprising a first end connected to said thumb body and a second end connected to said stiff-arm anchor at a location on said stiff-arm anchor that is located between said first and second mounts, wherein said first end of said stiff-arm anchor is located between said first removable pin assembly and an adjacent fixed structure, and the second end of said stiff-arm anchor is connected to said second mount.

10. A thumb for an excavator, said thumb comprising:

first and second spaced apart mounts;

a thumb body pivotally connected to said first mount by a first removable pin assembly, said second mount comprising a second removable pin assembly adapted for selectively connecting an associated hydraulic cylinder actuator to said second mount;

a stiff-arm anchor connected to and extending between said first and second mounts, said stiff-arm anchor comprising first and second ends releasably connected to said first and second mounts, respectively, so as to be selectively removable from said first and second mounts; and, a stiff-arm support link comprising a first end connected to said thumb body and a second end connected to said stiff-arm anchor at a location on said stiff-arm anchor that is located between said first and second mounts, wherein said second end of said stiff-arm anchor is located between said second removable pin assembly and an adjacent fixed structure, and the first end of said stiff-arm anchor is connected to said first mount.

* * * * *

UNITED STATES PATENT AND TRADEMARK OFFICE

CERTIFICATE OF CORRECTION

PATENT NO. : 9,151,012 B2
APPLICATION NO. : 13/585662
DATED : October 6, 2015
INVENTOR(S) : Seda et al.

It is certified that error appears in the above-identified patent and that said Letters Patent is hereby corrected as shown below:

Title Page,

Item [75], Inventors' name should be listed as follows:

--Anthony G. Seda, Ravenna, OH (US);

James J. Crook, Bedford, TX (US)--.

Signed and Sealed this
Tenth Day of May, 2016

Michelle K. Lee

Michelle K. Lee
*Director of the United States Patent and Trademark Office*